US011004666B2

(12) United States Patent
Choi et al.

(10) Patent No.: US 11,004,666 B2
(45) Date of Patent: May 11, 2021

(54) PORTABLE MINIATURIZED THERMIONIC POWER CELL WITH MULTIPLE REGENERATIVE LAYERS

(71) Applicant: UNITED STATES OF AMERICA AS REPRESENTED BY THE ADMINISTRATOR OF NASA, Washington, DC (US)

(72) Inventors: Sang H. Choi, Poquoson, VA (US); Adam J. Duzik, Merritt Island, FL (US)

(73) Assignee: UNITED STATES OF AMERICA AS REPRESENTED BY THE ADMINISTRATOR OF NASA, Washington, DC (US)

( * ) Notice: Subject to any disclaimer, the term of this patent is extended or adjusted under 35 U.S.C. 154(b) by 68 days.

(21) Appl. No.: 16/354,606

(22) Filed: Mar. 15, 2019

(65) Prior Publication Data

US 2019/0287773 A1 Sep. 19, 2019

Related U.S. Application Data

(60) Provisional application No. 62/643,292, filed on Mar. 15, 2018.

(51) Int. Cl.
*H01J 45/00* (2006.01)
*G21H 1/10* (2006.01)

(52) U.S. Cl.
CPC ..... *H01J 45/00* (2013.01); *G21H 1/106* (2013.01)

(58) Field of Classification Search
CPC ..... H01J 45/00; G21H 1/103
(Continued)

(56) References Cited

U.S. PATENT DOCUMENTS 4,497,973 A 2/1985 Heath et al.
5,637,946 A * 6/1997 Bushman ..... H02N 11/002 310/306

(Continued)

OTHER PUBLICATIONS

L. Popa-Simil, I.L. Popa-Simil, "Nano Hetero Nuclear Fuel Structure," NSTI-Nanotech, 2007, vol. 1, LAVM LLC, Los Alamos, NM 87544.

(Continued)

*Primary Examiner* — Terrance L Kenerly
(74) *Attorney, Agent, or Firm* — Shawn P. Gorman; Jennifer L. Riley; Helen M. Galus

(57) ABSTRACT

Systems, methods, and devices of the various embodiments may provide a portable power system for powering small devices that may be small, may be compact, may provide continuous power, and may be lightweight enough for an astronaut to carry. Various embodiments may provide a compact, thermionic-based cell that provides increased energy density and that more efficiently uses a heat source, such as a Pu-238 heat source. Nanometer scale emitters, spaced tightly together, in various embodiments convert a larger amount of heat into usable electricity than in current thermoelectric technology. The emitters of the various embodiments may be formed from various materials, such as copper (Cu), silicon (Si), silicon-germanium (SiGe), and lanthanides. Various embodiments may be added to regenerative thermionic cells with multiple layers to enhance the energy conversion efficiency of the regenerative thermionic cells.

17 Claims, 5 Drawing Sheets

(58) Field of Classification Search
USPC ..... 310/306
See application file for complete search history.

(56) References Cited

U.S. PATENT DOCUMENTS

| | | | | |
|---|---|---|---|---|
| 7,696,668 | B2 * | 4/2010 | Hu | H01L 35/00 310/305 |
| 10,269,463 | B2 | 4/2019 | Choi et al. | |
| 2008/0272680 | A1 | 11/2008 | Perreault | |
| 2013/0125963 | A1 | 5/2013 | Binderbauer et al. | |
| 2013/0313980 | A1 * | 11/2013 | Cheatham, III | H01J 17/22 315/161 |
| 2015/0188019 | A1 | 7/2015 | Corrado | |
| 2017/0125557 | A1 * | 5/2017 | Kub | H01L 29/267 |
| 2017/0288113 | A1 | 10/2017 | Choi et al. | |
| 2018/0350481 | A1 | 12/2018 | Choi et al. | |

OTHER PUBLICATIONS

Narducci, D., "Do we really need high thermoelectric figures of merit? A critical appraisal to the power conversion efficiency of thermoelectric materials," Appl. Phys. Lett., 2011, pp. 17-20, 99(10).
Stordeur, M. et al., "Low power thermoelectric generator—self-sufficient energy supply for micro systems," 16th Int. Conf. Thermoelectr., 1997, pp. 575-577.
National Aeronautics and Space Administration., "Radioisotope power systems: radioisotope thermoelectric generator (RTG)," 2013, <https://solarsystern.nasa.gov/rps/rtg.cfm> (Jan. 6, 2017 ).
Koelle, D. et al., "Development and transportation costs of space launch systems," Proc. DGLR/CEAS Eur. Air Sp. Conf. (2007).
Swanson, R. M., "A proposed thermophotovoltaic solar energy conversion system," Proc. IEEE, 1979, pp. 446-447, 67(3).
Schock, A. et al., "Design, analysis, and optimization of a radioisotope thermophotovoltaic (RTPV) generator, and its applicability to an illustrative space mission," Acta Astronaut. 37(C), 1995, pp. 21-57.
Ferrari, C. et al., "Overview and status of thermophotovoltaic systems," Energy Procedia 45, 2014, pp. 160-169.
Bermel, P. et al., "Design and global optimization of high-efficiency thermophotovoltaic systems.," Opt. Express 18 Suppl, 2010, pp. A314-A334, 3(103).
Nelson, R. E., "A brief history of thermophotovoltaic," Semicond. Sci. Technol. 2003, pp. S141-S143, 18.
Crowley, C. J. et al., "Thermophotovoltaic converter performance for radioisotope power systems," AIP Conf. Proc. 2005, 746, pp. 601-614.
Coutts, T. J. "Overview of thermophotovoltaic generation of electricity," Sol. Energy Mater. Sol. Cells, 2001, pp. 443-452, 66(1-4).
Murray, C. S. et al., "Thermophotovoltaic converter design for radioisotope power systems," AIP Conf. Proc Thermophotovoltaic Gener. Elect. 6th Conf., 2004, pp. 123-132.
Molesky, S. et al., "Ideal near-field thermophotovoltaic cells," Phys. Rev. B, 2015, pp. 1-7, 91(20).
Sulima, C.V. et al., "Fabrication and s mulation of GaSb thermophotovoltaic cells," Sol. Energy Mater. Sol. Cells, 2001, pp. 533-540, 66(1-4).
Coutts, T. J., "Review of progress in thermophotovoltaic generation of electricity," Renew. Sustain. energy Rev. 1999, pp. 77-184, 3(2).
Shakouri, A., "Thermoelectric , thermionic and thermophotovoltaic energy conversion J Q ( r ) q Report Documentation Page", 2005, pp. 1-6.
Rosaire, C. G. et al., "Radioisotope thermophotovoltaic batteries for universal low power systems," Nucl. Emerg. Technol. Space, NETS, 2013, pp. 419-427.
Cheetham, K. J. et al., "Low bandgap GaInAsSbP pentanary thermophotovoltaic diodes," Sol. Energy Mater. Sol. Cells, 2011, pp. 534-537, 95(2).
Nagpal, P. et al., "Efficient low-temperature thermophotovoltaic emitters from metallic photonic crystals," Nano Lett., 2008, pp. 3238-3243, 8(10).
Durisch, W. et al., "Novel thin film thermophotovoltaic system," Sol. Energy Mater. Sol. Cells, 2010, pp. 960-965, 94(6).
Schock, A. et al., "Design and integration of small RTPV generators with new millennium spacecraft for outer solar system," Acta Astronaut, 1997, pp. 801-816, 41(12).
Gerstenmaier, Y. C. et al., "Efficiency of thermionic and thermoelectric converters," AIP Conf. Proc., 2007, pp. 37-46, 890.
Oman, H. "Deep space travel energy sources," IEEE Aerosp. Electron. Syst. Mag., 2003, 18(2), pp. 28-35.
Humphrey, T. E. et al., "Power optimization in thermionic devices," J. Phys. D. Appl. Phys., 2005, pp. 2051-2054, 38(12).
Trucchi, D. M. et al., "Thermionic Emission□: A Different Path to Solar Thermal Electricity," SolarPaces Conf. (2012).
Schwede, J. W. et al., "Photon-enhanced thermionic emission for solar concentrator systems," Nat. Mater., 2010, pp. 762-767, 9(9),Nature Publishing Group.
Adams, S. F., "Solar thermionic space power technology testing: A historical perspective," AIP Conf. Proc., 2006, pp. 590-597, 813.
Ha, C. T. et al., "Advanced stirling radioisotope generator: Design processes, reliability analyses impacts, and extended operation tests," AIP Conf. Proc., 2008, pp. 458-465, 969.
Chan, J. et al., "Development of advanced Stirling Radioisotope Generator for space exploration," AIP Conf. Proc. , May 2007, 615-623, 880.
Wong, W. A. et al., "Advanced Stirling convertor ( ASC )—from technology development to future flight product," 2008, pp. 1-26.
Cockfield, R. D. et al., "Stirling radioisotope generator for mars surface and deep space missions," 2002 37th Intersoc. Energy Convers. Eng. Conf., 2002, pp. 134-139.
Shaltens, R. K. et al., "Advanced Stirling technology development at NASA Glenn Research Center," NASA Sci. Technol. Conf.(Sep. 2007).
Oriti, S. M., "Advanced Stirling Radioisotope Generator Engineering Unit 2 ( ASRG EU2 ) final assembly" (2015).
Mason., L. S. et al., "Modular stirling radioisotope generator," 13th Int. Energy Convers. Eng. Conf., 2015, 3809.
Chan, T. S., "System-level testing of the advanced Stirling radioisotope generator engineering hardware," 12th Int. Energy Convers. Eng. Conf. (2014).
Chan, J. et al., "Advanced stirling radioisotope generator emergency heat dump test for nuclear safety consideration," 9th Annu. Int. Energy Convers. Eng. Conf. IECEC 2011 (2011).
Leonov, V et al., "Wearable thermoelectric generators for body-powered devices," J. Electron. Mater., 2009, pp. 1491-1498, 38(7).
Leonov, V et al., "Thermoelectric and hybrid generators in wearable devices and clothes," Proc.—6th Int. Work. Wearable Implant. Body Sens. Networks, 2009, pp. 95-200.
Wang Z. L et al., "Realization of a wearable miniaturized thermoelectric generator for human body applications," Sensors Actuators, A Phys. 2009, pp. 95-102, 156(1).
Leonov, V, "Thermoelectric energy harvesting of human body heat for wearable sensors," IEEE Sens. J., 2013, pp. 2284-2291, 13(6).
Kim, M. K. et al., "Wearable thermoelectric generator for human clothing applications," 2013 Transducers Eurosensors XXVII 17th Int. Conf. Solid-State Sensors, Actuators Microsystems,(Jun. 2013), pp. 1376-1379.
He, W. et al., "Recent development and application of thermoelectric generator and cooler," Appl. Energy, 2015, pp. 1-25, 143.
Bahk, J. H. et al., "Flexible thermoelectric materials and device optimization for wearable energy harvesting," J. Mater. Chem. C 3, 2015, pp. 10362-10374.
Sebald, G. et ai., "On thermoelectric and pyroelectric energy harvesting," Smart Mater. Struct. 2009,18(12), p. 25006, pp. 1-7.
Miotla, D., "Assessment of plutonium-238 production alternatives," Apr. 21, 2008 (available at http://energy.gov/sites/prod/files/NEGTN0NEAC_PU-238_042108.pdf), downloaded on Oct. 4, 2018.
National Aeronautics and Space Administration., "What is plutonium-238," <https://solarsystem.nasa.gov/rps/docs/APP RPS Pu-238 FS 12-10-12.pdf> (Jan. 25, 2016 ), downloaded on Oct. 4, 2018.

(56) References Cited

OTHER PUBLICATIONS

Howe, S. D. et al., "Economical production of Pu-238," Nucl. Emerg. Technol. Sp. (NETS 2013) 2013, pp. 1-12, 238.
Wall, M., "Full-Scale Production of Plutonium Spacecraft Fuel Still Years Away," Space.com, May 17, 2016, (avaiiable at http://www.space.com/32890-nuclear-fuel-spacecraft-production-plutonium-238.html), downloaded on Oct. 4, 2018.
Griggs, M. B., "Plutonium-238 is produced in America for the first time in almost 30 Years," Pop. Sci., Dec. 23, 2015 (available at http://www.popsci.com/plutonium-238-is-produced-in-america-for-first-time-in-30-years), downloaded on Oct. 4, 2018.
Szondy, D., "US restarts production of plutonium-238 to power space missions," New Atlas, Dec. 23, 2015 (available at http://newatlas.com/ornl-plutonium-238-production-space/41041/), downloaded on Oct. 4, 2018.

* cited by examiner

PORTABLE MINIATURIZED THERMIONIC POWER CELL WITH MULTIPLE REGENERATIVE LAYERS

CROSS-REFERENCE TO RELATED PATENT APPLICATION(S)

This patent application claims the benefit of and priority to U.S. Provisional Application No. 62/643,292, filed on Mar. 15, 2018, the contents of which are hereby incorporated by reference in their entirety.

STATEMENT REGARDING FEDERALLY SPONSORED RESEARCH OR DEVELOPMENT

The invention described herein was made in the performance of work under a NASA contract and by an employee of the United States Government and is subject to the provisions of Public Law 96-517 (35 U.S.C. § 202) and may be manufactured and used by or for the Government for governmental purposes without the payment of any royalties thereon or therefore. In accordance with 35 U.S.C. § 202, the contractor elected not to retain title.

BACKGROUND OF THE INVENTION

Astronauts with portable tools, rovers, and other deployable devices and systems require either imbedded batteries or cable connection to power source to function. Both methods require contact with a central power source for recharge of batteries or power feed through cable. Ideally, a power source for portable equipment and deployable systems must be small, compact, provide continuous power, and be lightweight enough for an astronaut and rovers to carry. Batteries can meet some of those requirements, but do not meet the continuous power requirement. Batteries have short or limited lifetimes and required constant replacement and recharging. All deep space probes require simple, small, light, long-term operational, and inexpensive power sources. However, no other choices are available but use of large, bulky, heavy, and costly radioisotope thermoelectric generators (RTGs) appears only an option regardless of enhancing capability and functionality of the probes. Moreover, the conversion mechanism, thermoelectric (TE) generator, is very inefficient, only operating at approximately 7% efficiency, and RTGs require a large quantity (e.g., kilogram level) of plutonium-238 (Pu-238), a difficult and expensive materials to produce in large amounts. Solar cells are unusable for deep space operations where light density is too low and the efficiency of solar cells is rather low, requiring impractically large flat panel arrays to harvest usable amounts of power. Thus, solar cells are not suitable for powering astronaut systems and tools.

No continuous long-term operational, portable power system currently exists for powering small devices. Ideally, a portable power system for powering small devices must be small, compact, provide continuous power, and be lightweight enough for an astronaut to carry. Batteries can meet some of those requirements, but do not meet the continuous power requirement. RTGs can meet the continuous power requirement, but none of the other requirements. Solar cells do not meet the continuous power requirement or the small, compact, and lightweight requirements. The lack of the current existence of a continuous, portable power system for powering small devices limits both manned and unmanned space missions.

BRIEF SUMMARY OF THE INVENTION

Systems, methods, and devices of the various embodiments may provide a portable power system for powering small devices that may be small, may be compact, may provide continuous power, and may be lightweight enough for an astronaut to carry. Various embodiments may provide a compact, thermionic-based cell that provides increased energy density and that more efficiently uses the heat source of an RTG, such as the Pu-238 heat source. Nanometer scale emitters, spaced tightly together, in various embodiments convert a larger amount of heat into usable electricity than in current thermoelectric technology. The emitters of the various embodiments may be formed from common materials, such as copper (Cu), silicon (Si), silicon-germanium (SiGe), and lanthanides, all easily fabricated to nanometer size in current Fin Field Effect Transistor (FinFET) complementary metal-oxide-semiconductor (CMOS) processes. Various embodiments may be added to regenerative thermionic cells with multiple layers to enhance the energy conversion efficiency of the regenerative thermionic cells.

These and other features, advantages, and objects of the present invention will be further understood and appreciated by those skilled in the art by reference to the following specification, claims, and appended drawings.

BRIEF DESCRIPTION OF THE SEVERAL VIEWS OF THE DRAWINGS

The accompanying drawings, which are incorporated herein and constitute part of this specification, illustrate exemplary embodiments of the invention, and together with the general description given above and the detailed description given below, serve to explain the features of the invention.

DETAILED DESCRIPTION OF THE INVENTION

The various embodiments will be described in detail with reference to the accompanying drawings. Wherever possible, the same reference numbers will be used throughout the drawings to refer to the same or like parts. References made to particular examples and implementations are for illustrative purposes, and are not intended to limit the scope of the invention or the claims. For purposes of description herein, the terms "upper," "lower," "right," "left," "rear," "front," "vertical," "horizontal," and derivatives thereof shall relate to the invention as oriented in FIG. 3. However, it is to be understood that the invention may assume various alternative orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
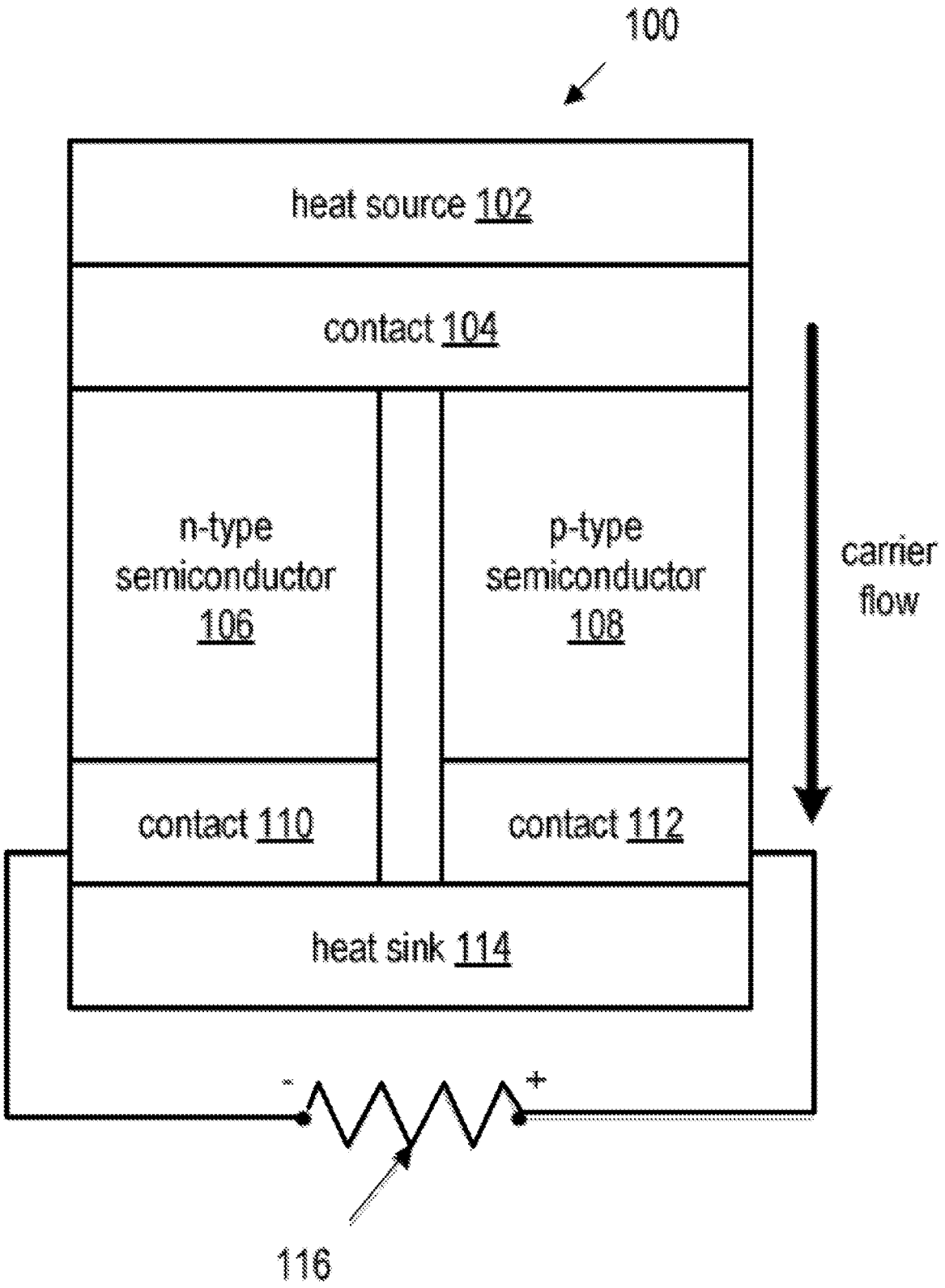
FIG. 1 is a block diagram of an example thermoelectric-based power generator.

FIG. 1 is a block diagram schematic of an illustrative thermoelectric generator 100. The illustrated thermoelectric generator is a solid state device that converts thermal energy directly into electrical energy. The thermoelectric generator 100 includes a heat source 102. In a RTG, which is a combination of thermoelectric generator and a radioactive heat source, the heat source 102 is a heat-generating radioactive material, such as Pu-238. The heat source 102 is coupled to an n-type semiconductor material 106 and a p-type semiconductor material 108 via contact 104. A heat sink 114 is coupled to the n-type semiconductor material 106 via contact 110 and the p-type semiconductor material 108 via contact 112. The heat generated by the heat source 102 drives electrons and hole carriers in the n-type and p-type semiconductor materials 106 and 108, respectively, toward the heat sink 114, which results in a continuous current flow. An electrical load 116 can be coupled to the contacts 110 and 112 to supply an electric current flow to the electrical load 116. However, the amount of current generated by thermoelectric generators is limited by multiple factors.

Carrier concentrations of semiconductor materials used in thermoelectric generators are less than carrier concentrations of metals (about two to three orders of magnitude less) that are used in other types of power supplies. Moreover, the figure of merit (FoM) of the thermoelectric generator 100 is limited. A high FoM requires high electrical conductivity and low thermal conductivity but this is a severe obstacle as these are two properties that rarely go together. Because the FoM is inversely related to the thermal conductivity, an "ideal" thermoelectric generator would have a thermal conductivity of zero. But if the thermal conductivity was zero, then no heat would flow in the thermoelectric generator and, therefore, no thermal power could be converted to electrical power.

Figure 2:
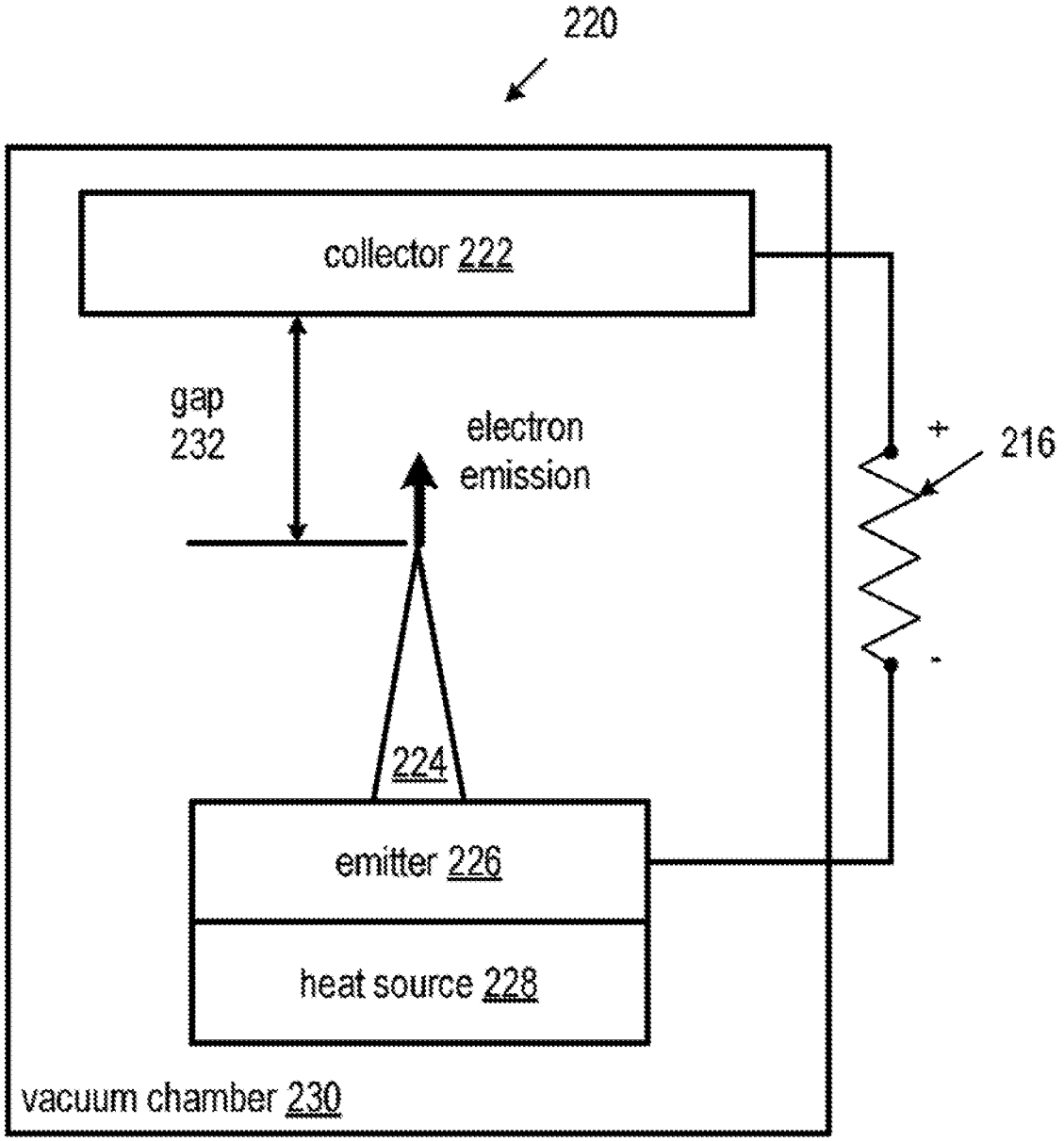
FIG. 2 is a block diagram of an example thermionic power generator.

FIG. 2 is a block diagram illustration of a thermionic generator 220. In contrast to the thermoelectric generator 100 shown in FIG. 1, the thermionic generator 220 uses thermionic emission to generate an electrical current. Thermionic emission is the thermally induced flow of charge carriers (e.g., electrons, ions) from a surface. Thermionic emission occurs when the thermal energy (heat) given to a charge carrier overcomes the work function of the material so that the charge carrier is emitted from the material. As used herein, "work function" refers to the minimum thermodynamic work (i.e., the amount of energy) necessary to remove a charge carrier from a solid material to a point in a vacuum immediately outside the surface of the solid material.

The thermionic generator 220 includes a heat source 228 coupled to an electron emitter 226. The heat source 228 provides heat to the electron emitter 226 to generate an electric potential in the electron emitter 226. As shown in FIG. 2, the electron emitter 226 can include a spike 224 to focus the electric potential generated in the electron emitter 226 at the tip of the spike 224. Focusing the electric potential aids in energizing electrons of the electron emitter 226 so that the electrons escape the electron emitter 226 entirely, via the spike 224, and into the vacuum chamber 230. The thermionic generator 220 includes an electron collector 222 to collect the electrons emitted from the electron emitter 226. An electrical load 216 can be coupled to the electron collector 222 and the electron emitter 226 to supply an electric current flow to the electrical load 216.

The current density generated by thermionic emission is quantified by the Richardson-Dushman equation. Heating the electron emitter 226 to approximately 800 to 1000 degrees Celsius (° C.) generates a measurable current density by thermionic emission. Shortening the gap 232 between the electron emitter 226 and the electron collector 222, or the gap 232 between the tip of the spike 224 and the electron collector 222 as shown in FIG. 2, increases the electric current flow generated by the thermionic generator 220. The distance of the gap 232 can range between approximately 100 micrometers (μm) to 1 millimeter (mm). The current flow generated by the thermionic generator 220 increases with an increase in the sharpness of the emitter spikes (e.g., 224) and the topological arrangement of the spikes (e.g., number of spikes per area (spike density)) on the surface of the electron emitter 226 of the thermionic generator 220 (e.g., a smaller vacuum gap 232). Changing the distance of the gap 232 between the spike 224 and the electron collector 222 has a significant impact of the current flow generated by the thermionic generator 220. Optimizing the distance of the gap 232 and/or the size of the spikes (e.g., 224) without reducing the number of electrons available for thermionic emission is preferable. The spikes can be uniform in size and shape to maintain a uniform gap 232.

Systems, methods, and devices of the various embodiments may provide a portable power system for powering small devices that may be small, may be compact, may provide continuous power, and may be lightweight enough for an astronaut to carry. Various embodiments may provide a compact, thermionic-based cell that provides increased energy density and that more efficiently uses the heat source of an RTG, such as the Pu-238 heat source. Nanometer scale emitters, spaced tightly together, in various embodiments convert a larger amount of heat into usable electricity than in current thermoelectric technology. The emitters of the various embodiments may be formed from common materials such as Cu, Si, SiGe, and lanthanides, all easily fabricated to nanometer size in current FinFET complementary metal-oxide-semiconductor (CMOS) processes. Various embodiments may be added to regenerative thermionic cells with multiple layers to enhance the energy conversion efficiency of the regenerative thermionic cells. Various embodiments may provide continuous power for low consumption (e.g., 10-15 Watt (W)) devices. Various embodiments may operate continuously, thereby simplifying use compared with batteries. Various embodiments may provide a drop-in replacement that may be substituted for conventional battery and/or solar cell power systems. Various embodiments may be vastly more reliable and longer lived than current small device power methods. The various embodiments may have no moving parts and provide power for decades based on the long half-life of Pu-238. Additionally, the various embodiments may not be susceptible to chemical decay as are batteries or to the breakdown due to high energy radiation in space as experienced by solar cells. Various embodiments may enable many new applications for space exploration, making microsatellites more feasible for deep space exploration that otherwise would be unjustifiable with a full-size probe.

Figure 3:
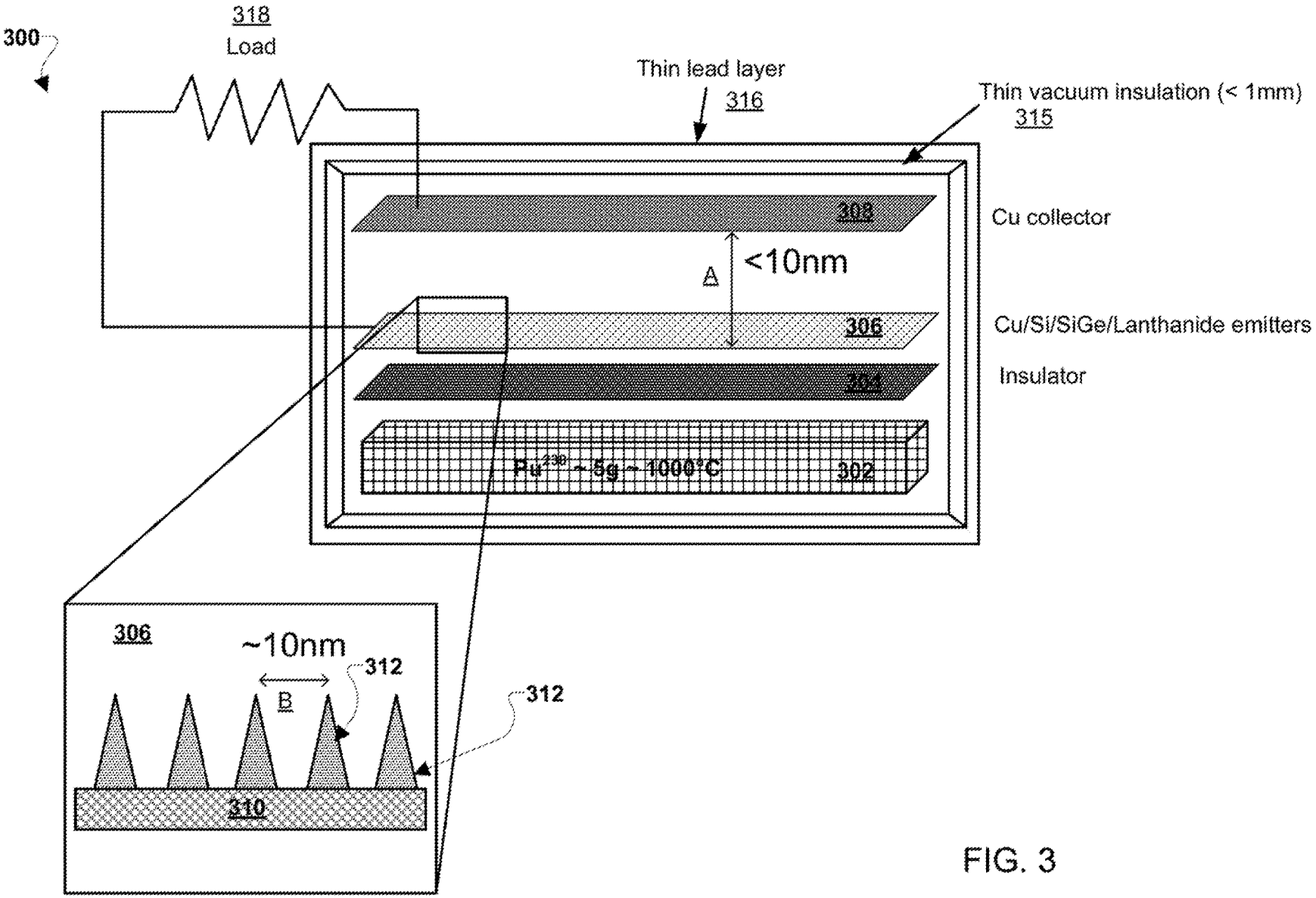
FIG. 3 is a block diagram of an embodiment compact thermionic cell.

FIG. 3 is a block diagram of an embodiment compact thermionic cell 300. The compact thermionic cell 300 may include a heat source 302, insulator 304, emitter 306, and collector 308. The heat source 302, insulator 304, emitter 306, and collector 308 may be disposed within a housing including a vacuum insulation layer 315 surrounded by a thin lead layer 316 (e.g., 2-3 mm lead layer). The vacuum insulation layer 315 may maintain a vacuum within the housing and may support a continuous temperature gradient of at least 500° C. per mm. The vacuum insulation layer 315 may be formed from molded vacuum gap insulation and may be a 1 mm vacuum layer. The heat source 302, insulator 304, emitter 306, and collector 308 may each be formed is a separate layer and the various layers of heat source 302, insulator 304, emitter 306, and collector 308 may be arranged on top of one another such that the insulator 304 separates the emitter 306 and collector 308 from the heat source 302. The emitter 306 may be arranged between the collector 308 and heat source 302, such as between the insulator 304 and collector 308. The heat source 302 may be formed from a heat-generating radioactive material, such as Pu-238. The heat source 302 may be at a temperature of approximately 1000° C. As a specific example, the heat source may be approximately five (5) grams (g) of Pu-238, such as less than 5 g, 5 g, more than 5 g, etc. 5 g of Pu-238 may be far less Pu-238 than is used in current RTGs. Additionally, 5 g of Pu-238 may be more readily producible and easily reusable in other manned missions than the amounts used in current RTGs.

The insulator 304 may be a layer of material disposed over the heat source 302. The insulator 304 may be configured to protect the emitter 306 and collector 308 from overheating and from Pu-238 alpha ($\alpha$) and gamma ($\gamma$) radiation.

The emitter 306 may be comprised of copper (Cu), silicon (Si), silicon germanium (SiGe), or lanthanide pointed emitters, which can be fabricated into an array of isolated points or an array of one-dimensional (1D) ridges. FIG. 3 shows an expanded view of the emitter 306 showing emitter points 312 extending from a base 310 of the emitter 306. The smaller the emitter points 312, the higher the voltage concentration. It is estimated that 1 $cm^2$ of such an array of emitter points 312 can produce upwards of 4 W, which increases with a closer emitter spacing. Emitter spacing is illustrated by the space 'B', which may be approximately 10 nm, such as less than 10 nm, 10 nm, greater than 10 nm, etc. Current FinFET semiconductor processing readily reaches device sizes of 20 nm or less with Cu, Si, SiGe, and lanthanides. Such technology can be adapted to fabricating high emission density emitter layers, such as emitter 306.

Figure 4:
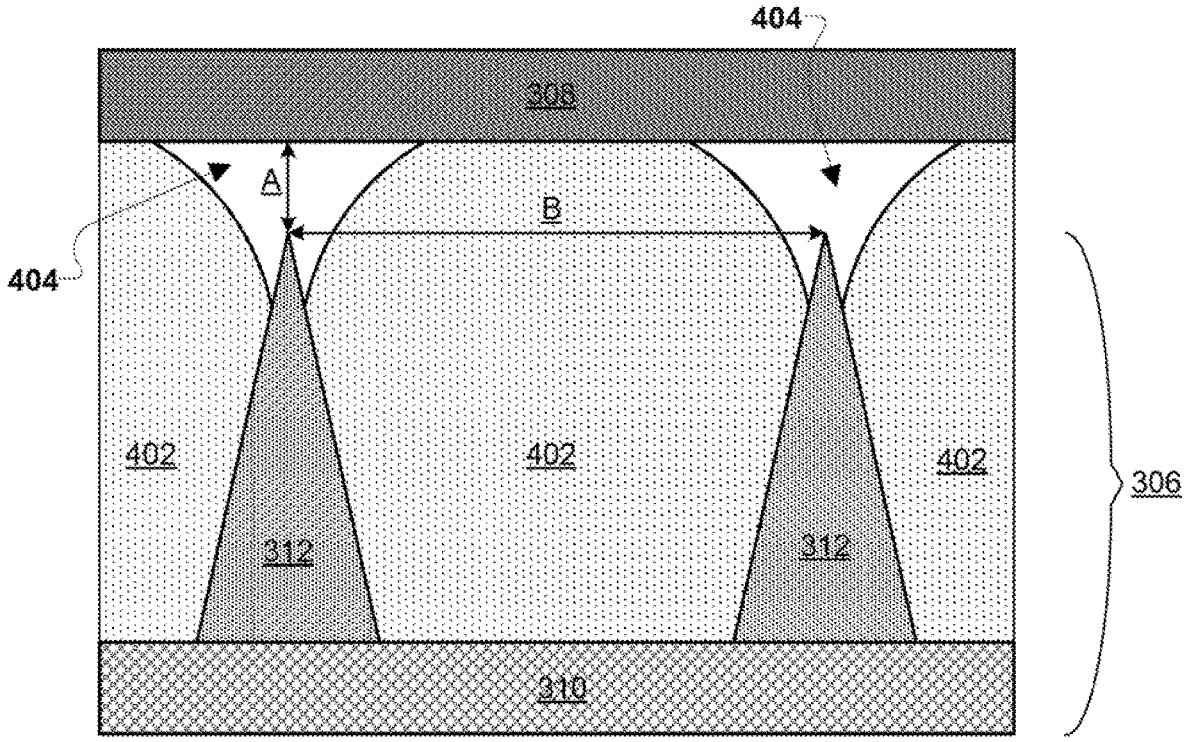
FIG. 4 is a block diagram of an emitter circuit portion of a thermionic cell according to an embodiment.

The collector 308 may is a thin Cu plate, positioned within 10 nm or closer to the emitter tips, resulting in a gap 'A' between the collector 308 and the upper most portion (e.g., the tips of emitters 112) of the emitter 306. Such a gap 'A' can be produced according to the pattern in FIG. 4. FIG. 4 shows the emitter 306 below the collector 308. Oxide or nitride spacer 402 is shown deposited onto the emitter array 306 as a spacer layer. The spacer layer of oxide or nitride spacer 402 may be added after the emitter points 312 are patterned on the based 310 (e.g., by etching, deposition, etc.). The spacer layer of oxide or nitride spacer 402 may deposited and then polished flat with chemical mechanical polishing to within 10 nm of the emitter 306 (e.g., within 10 nm measured from the apex of the emitter points 312). The spacer over the emitter points 312 may be selectively patterned, chemically removed, and then replaced with a temporary spacer material. This temporary spacer material may be removable with an etchant that does not affect the original spacer material (i.e., oxide or nitride spacer 402). The collector metal (e.g., Cu) is deposited to form the collector 308 as a layer. Finally, the temporary spacer material between the emitter points 312 and the collector 308 may be removed using a selective etchant that does not affect the original spacer material (i.e., oxide or nitride spacer 402) to remove the temporary spacer material. Holes etched into the collector 308 may permit this etchant into the temporary spacer material to accomplish the removal of the temporary spacer material. The resulting combined emitter 306 and collector 308 with oxide or nitride spacers 402 may include open areas 404 at each emitter point 312. The resulting combined emitter 306 and collector 308 with oxide or nitride spacers 402 may be arranged above the insulator 304 and heat source 302 and the emitter 306 and collector 308 may be connected to a load 318. In some embodiments, the cell size of the cell 300 may be on the order of 5×3×0.5 cm.

Figure 5:
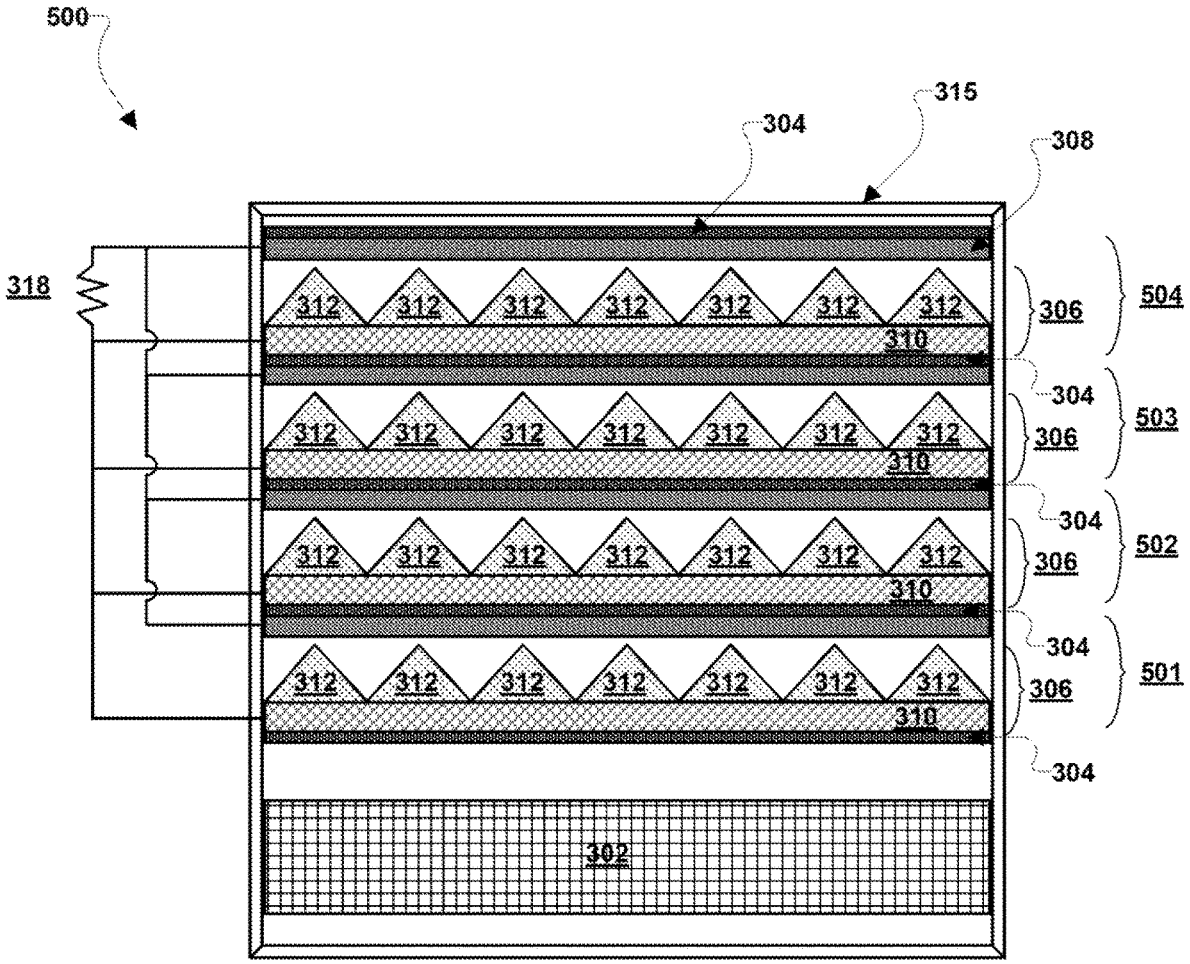
FIG. 5 is a block diagram of another embodiment compact thermionic cell.

FIG. 5 is a block diagram of another embodiment compact thermionic cell 500. Thermionic cell 500 is similar to thermionic cell 300, except that thermionic cell may include multiple thermionic layers (e.g., two, three, four, five, or more layers). FIG. 5 shows the thermionic cell 500 with four layers 501, 502, 503, and 504, but more or less layers may be added. Each layer 501, 502, 503, and 504 comprises its own emitter 306 and collector 308 arranged as described above with reference to FIG. 3. The layers 501, 502, 503, and 504 may be stacked one on top of each other extending up from the heat source 302. Efficiency is limited mostly by the number of emitters 306 that can be packed onto the array. The more there are, the better the heat utilization from the Pu-238 heat source 302. Power output can be increased from that of the cell 300 by stacking multiple emitter 306 and collector 308 assemblies (i.e., multiple layers, such as layers 501, 502, 503, and 504) on top of one another, as shown in FIG. 5. Each layer 501, 502, 503, and 504 of the cell 500 has a base 310 with emitter arrays of emitter points 312 fabricated on top, pointed towards a collector 308, with each layer 501, 502, 503, and 504 separated from one another by an insulator 304 that is both electrical insulative and thermally conductive. The heat from the heat source 302 will pass through the bottom most layer 501, with the heat contained and directed upward by the thermally insulative vacuum gap shroud 315, depicted as the surrounding box in FIG. 5. As the bottom most layer 501 heats, its radiative heat transfer will increase, and the incoming emitted electrons will surrender some energy to thermal loss, heating the collector 308 of that layer 501. This will in turn transfer through the electrical insulator 304 by conduction, then heat the emitter 306 of the next layer 502, causing thermionic emission on that layer 502. The second layer 502 temperature will be lower than the first layer 501, but the amount of transformed thermal to electrical power will be higher. The heat would be lost otherwise if the second layer 502 was not present. This process repeats, albeit with diminishing effect, for each subsequent layer, 503, 504, etc. until the remaining thermal energy is insufficient to induce thermionic emission, whereupon there is no point in adding additional layers. Similar to the cell 300, the cell 500 may include a thin lead layer 316 surrounding the vacuum insulation layer 315 of the cell 500 to create a housing of the cell 500. FIG. 5 illustrates each of the layers 501, 502, 503, and 504 connected in parallel to the load 318.

Various embodiments may be useful in applications where heat for a high thermal energy source, such as a greater than 500° C. source, may be available for conversion to electrical power. For example, various embodiments may be used in coal burning power plants, may be applied to thermal engines, and may be used where concentrated solar energy conversion provides sufficient high thermal energy.

The preceding description of the disclosed embodiments is provided to enable any person skilled in the art to make or use the present invention. Various modifications to these embodiments will be readily apparent to those skilled in the art, and the generic principles defined herein may be applied to other embodiments without departing from the scope of the invention. Thus, the present invention is not intended to be limited to the aspects and/or embodiments shown herein but is to be accorded the widest scope consistent with the following claims and the principles and novel features disclosed herein.

All cited patents, patent applications, and other references are incorporated herein by reference in their entirety. However, if a term in the present application contradicts or conflicts with a term in the incorporated reference, the term from the present application takes precedence over the conflicting term from the incorporated reference.

All ranges disclosed herein are inclusive of the endpoints, and the endpoints are independently combinable with each other. Each range disclosed herein constitutes a disclosure of any point or sub-range lying within the disclosed range.

The use of the terms "a" and "an" and "the" and similar referents in the context of describing the invention (especially in the context of the following claims) are to be construed to cover both the singular and the plural, unless otherwise indicated herein or clearly contradicted by context. "Or" means "and/or." As used herein, the term "and/or" includes any and all combinations of one or more of the associated listed items. As also used herein, the term "combinations thereof" includes combinations having at least one of the associated listed items, wherein the combination can further include additional, like non-listed items. Further, the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

Reference throughout the specification to "another embodiment", "an embodiment", "exemplary embodiments", and so forth, means that a particular element (e.g., feature, structure, and/or characteristic) described in connection with the embodiment is included in at least one embodiment described herein, and can or cannot be present in other embodiments. In addition, it is to be understood that the described elements can be combined in any suitable manner in the various embodiments and are not limited to the specific combination in which they are discussed.

It is to be understood that variations and modifications can be made on the aforementioned structure without departing from the concepts of the present invention, and further it is to be understood that such concepts are intended to be covered by the following claims unless these claims by their language expressly state otherwise.

What is claimed is:

1. A thermionic power cell, comprising:

a housing including a lead layer and a vacuum insulation layer;

a heat source within the housing;

a first layer within the housing, the first layer comprising:

a first collector; and a first emitter arranged such that the first emitter is disposed between the heat source and the first collector; and one or more additional layers within the housing, each additional layer comprising:

an additional collector; and an additional emitter arranged such that the additional emitter of that additional layer is disposed between the heat source and the additional collector of that additional layer, wherein each additional layer is successively stacked upon the first layer and all layers are electrically insulated from one another, wherein the first emitter and each additional emitter each comprise an array of emitter points extending from a base, wherein a separation between the first emitter and the first collector is 10 nanometers or less and a separation between each additional emitter and its respective each additional collector is 10 nanometers or less, and wherein the first emitter and each additional emitter are comprised of copper (Cu), silicon (Si), silicon germanium (SiGe), or a lanthanide and the first collector and each additional collector are comprised of Cu.

2. The thermionic power cell of claim 1, wherein the heat source is comprised of plutonium 238 (Pu-238).

3. The thermionic power cell of claim 2, wherein the heat source is five grams of Pu-238.

4. The thermionic power cell of claim 2, wherein the first layer and each additional layer each include a respective spacer layer of oxide or nitrate between their respective emitters and collectors.

5. The thermionic power cell of claim 1, wherein the one or more additional layers are three additional layers.

6. The thermionic power cell of claim 1, wherein the first spacer layer is made of oxide or nitrate.

7. The thermionic power cell of claim 1, wherein the first emitter includes a first array of emitter spikes having first emitter tips, and wherein the first spacer layer is positioned on the first emitter.

8. The thermionic power cell of claim 7, wherein the first spacer layer does not cover the first emitter tips so that first open spaces are formed at the first emitter tips.

9. The thermionic power cell of claim 8, wherein the first open spaces extend between the first emitter tips and the first collector.

10. The thermionic power cell of claim 9, wherein the first spacer layer extends between and contacts the first emitter and the first collector, except for the first open spaces.

11. The thermionic power cell of claim 7, wherein the first spacer layer is made of oxide or nitrate.

12. The thermionic power cell of claim 7, wherein the first emitter includes a first base from which the first array of emitter spikes extend, and wherein the first spacer layer extends between the emitter spikes of the first array at the first base.

13. The thermionic power cell of claim 7, wherein a separation between the first emitter tips and the first collector is 10 nanometers or less.

14. A method of generating electrical current, comprising:

providing a thermionic power cell; and connecting the thermionic power cell to a load to generate an electrical current, wherein the thermionic power cell comprises:

a housing including a vacuum layer for insulation surrounded by a lead layer for radiation shielding and;

a heat source within the housing;

a first layer within the housing, the first layer comprising:

a first collector; and a first emitter arranged such that the first emitter is disposed between the heat source and the first collector; and one or more additional layers within the housing, each additional layer comprising:

an additional collector; and an additional emitter arranged such that the additional emitter of that additional layer is disposed between the heat source and the additional collector of that additional layer;

wherein each additional layer is successively stacked upon the first layer and all layers are electrically insulated from one another.

15. The method of claim 14, wherein the heat source is comprised of plutonium 238 (Pu-238).

16. The method of claim 15, wherein the heat source is five grams of Pu-238.

17. The method of claim 15, wherein the first layer and each additional layer each include a respective spacer layer of oxide or nitrate between their respective emitters and collectors.

* * * * *